US005113879A

United States Patent [19]

Alleon

[11] Patent Number: 5,113,879

[45] Date of Patent: May 19, 1992

[54] LIGHTED CIGARETTE DISPENSING APPARATUS

[76] Inventor: Alain G. J. M. Alleon, 116, rue des Moines, 75017 Paris, France

[21] Appl. No.: 719,766

[22] Filed: Apr. 4, 1985

[30] Foreign Application Priority Data

Apr. 16, 1984 [FR] France ..... 84 05992

[51] Int. Cl.[5] ..... F23Q 2/00; F23Q 7/00; A24F 13/00

[52] U.S. Cl. ..... 131/329; 131/182; 219/267; 219/268; 219/263

[58] Field of Search ..... 131/329; 219/268, 263, 219/262, 267

[56] References Cited

U.S. PATENT DOCUMENTS 1,967,114 7/1934 Cutler .
2,311,632 2/1943 Berger et al. .
2,360,418 10/1944 Hedstrom .
3,144,170 8/1964 Peer .

FOREIGN PATENT DOCUMENTS 2740015 8/1974 Fed. Rep. of Germany .
1483895 6/1969 France .

*Primary Examiner*—V. Millin

[57] ABSTRACT

An apparatus for dispensing lighted cigarettes is provided comprising a magazine open at its base and divided inwardly by vertical and parallel dividing walls into compartments such receiving a stack of cigarettes of a given brand, each compartment being provided with a selection device which, when it is actuated, lets the lowest cigarette in the compartment drop, a mobile floor passing under the magazine and having a cell parallel to the axis of the cigarette, a reversible motor for driving the mobile floor parallel to the base of the lighting device extending into the housing to light a cigarette therein of one of the selection devices, a housing parallel to the cell for receiving the selected cigarette and a lighting device mounted for sliding along said housing.

17 Claims, 4 Drawing Sheets

LIGHTED CIGARETTE DISPENSING APPARATUS

BACKGROUND OF THE INVENTION

1. Field of the Invention

The present invention relates to a cigarette dispenser for stocking cigarettes of different brands and dispensing them selectively in the lighted condition.

2. Description of the Prior Art

From U.S. Pat. No. 3,144,170 an article dispenser is known comprising a magazine formed from an assembly of open bottom compartments which each receive a pile of articles capable of being dispensed by gravity through the bottom of the compartments. Each compartment is parallelepipedic and comprises two opposite vertical longitudinal side walls one of which is mounted for pivoting about a horizontal axis passing through its upper edge, so as to be able to move away from the other longitudinal side which is fixed. The pivoting wall has at its lower edge a shoulder extending inwardly of the compartment for retaining the whole pile of articles. With each compartment is associated a retaining element in the form of a horizontal loop disposed in the gap between two adjacent compartments, said loop being movable in its plane through an opening formed in the lower part of the fixed longitudinal wall of the compartment for engagement under the article situated above the lowest article in the pile. The longitudinal pivoting wall and the loop shaped element are interlocked in movement so that when they are moved away from their normal position, the lower article of the pile falls onto a receiving belt whereas the rest of the articles are retained by the looped shaped element.

Such a dispenser has several drawbacks. First of all, each compartment must be separated from the adjacent one by the width of the loop shaped element, which results in waste of space for storing articles. In addition, once the lower article has been released, means must be provided for conveying it to the front wall of the dispenser where it will be accessible to the user. This dispenser requires then two manual operations: one for releasing an article and one for bringing it within reach of the user. Furthermore, when it is a question of dispensing elongate articles, such as cigarettes, they are presented to the user parallel to the front wall of the dispenser which is a position in which it cannot be readily picked up. Finally, this dispenser, despite its lack of automation, is of complicated and space consuming construction, the use thereof for dispensing cigarettes is not advisable in a motor vehicle since the two above mentioned operations as well as that for lighting the dispensed cigarette lead to a relaxation of the visual attention and manual control of the driver.

From French patent 1 483 895 a dispenser is known for lighted cigarettes but which has no automation and which can only dispense a single brand of cigarettes.

The aim of the present invention is to overcome the disadvantages of the dispensers disclosed in these patents and therefore provide an entirely automatic dispenser which, with a single control operation, dispenses a cigarette of the brand chosen by the smoker and provides it lighted.

SUMMARY OF THE INVENTION

The cigarette dispenser of the invention is of the type comprising;

a magazine, preferably parallelepipedic in shape, open at its base and divided on the inside into adjacent fixed wall compartments each receiving, in the laid flat position, a pile of cigarettes of a given brand and/or dimensions, for each of the compartments, a selection device able to be brought manually from a normal closed position in which it prevents the cigarettes in the compartment from dropping through its base, to an open position in which it allows the lowest cigarette in the compartment to pass, a mobile floor moving in the magazine perpendicularly to the axis of the cigarettes and having an opening or cell parallel to the axis of the cigarettes and dimensions so as to receive only one cigarette at a time, when it passes under one of the compartments whose associated selection device has been previously brought into an open position, a reversible motor for driving said mobile floor in an outward direction then in the return direction, said motor being started up by actuation of one of the selection device, a fixed housing parallel to the direction of said cell and situated at the end of the outward travel of the mobile floor, so as to receive the selected cigarette driven by said cell, a pivoting flap closing the housing at one end, a lighting device fixed to a sleeve which is mounted for sliding along said housing on a guide rod and urged by spring means against one end of the cigarette, this latter itself bearing against the pivoting flap, first control means actuated when the mobile floor moves in the outward direction so as to move the lighting device away from said pivoting flap so as to provide a space for a cigarette in the housing, and second control means actuated when said mobile floor moves in the return direction, so as to control opening of the pivoting flap and so ejection of the lighted cigarette under the thrust of said spring means.

BRIEF DESCRIPTION OF THE DRAWINGS

The invention will be better understood from reading the detailed description of one non limitative embodiment, with reference to the accompanying drawings in which.

DESCRIPTION OF THE PREFERRED EMBODIMENTS

Figure 1:
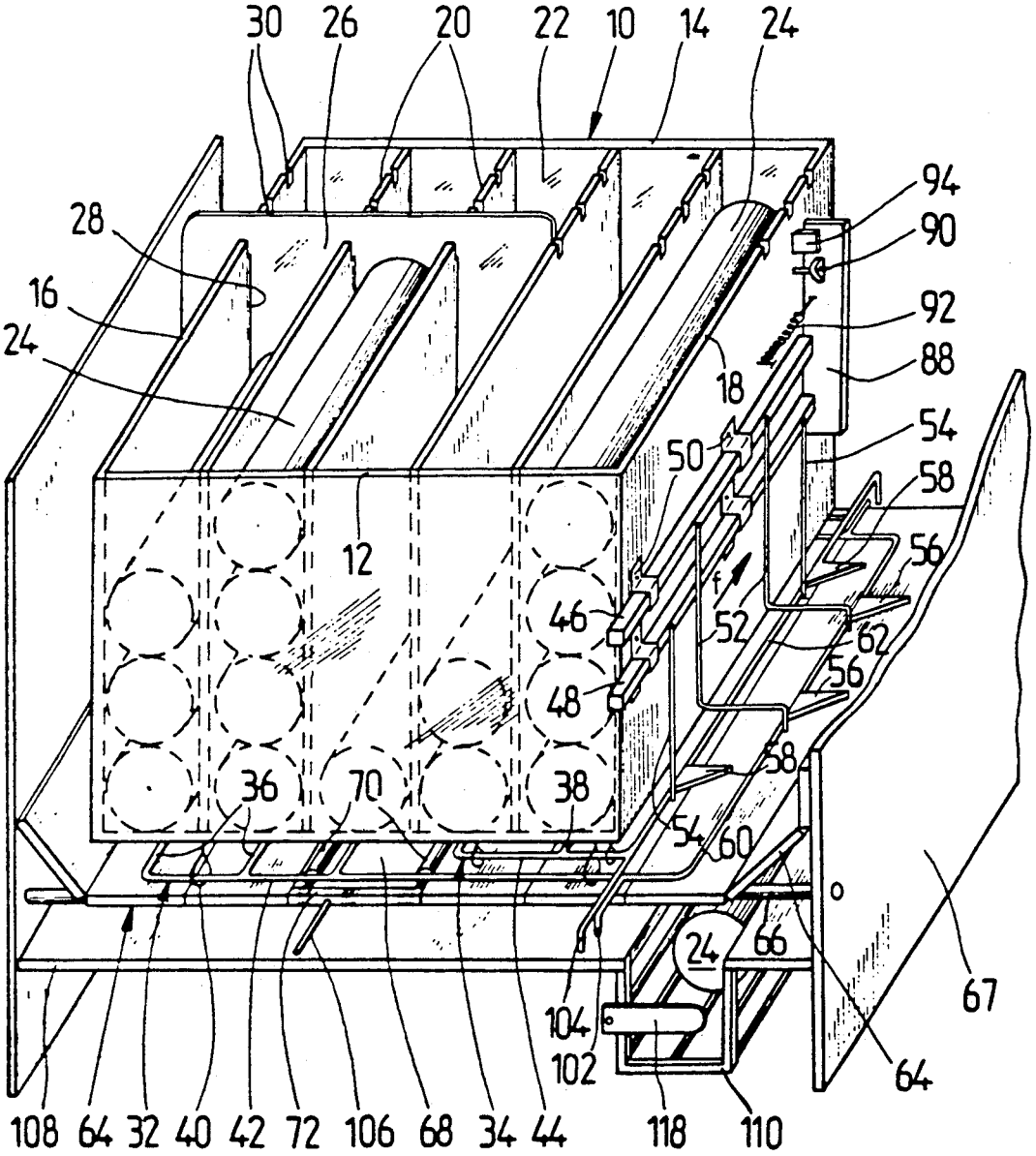
FIG. 1 is a perspective view of a cigarette dispenser according to one embodiment in which the lighted cigarettes are presented through the front of the magazine.
Figure 2:
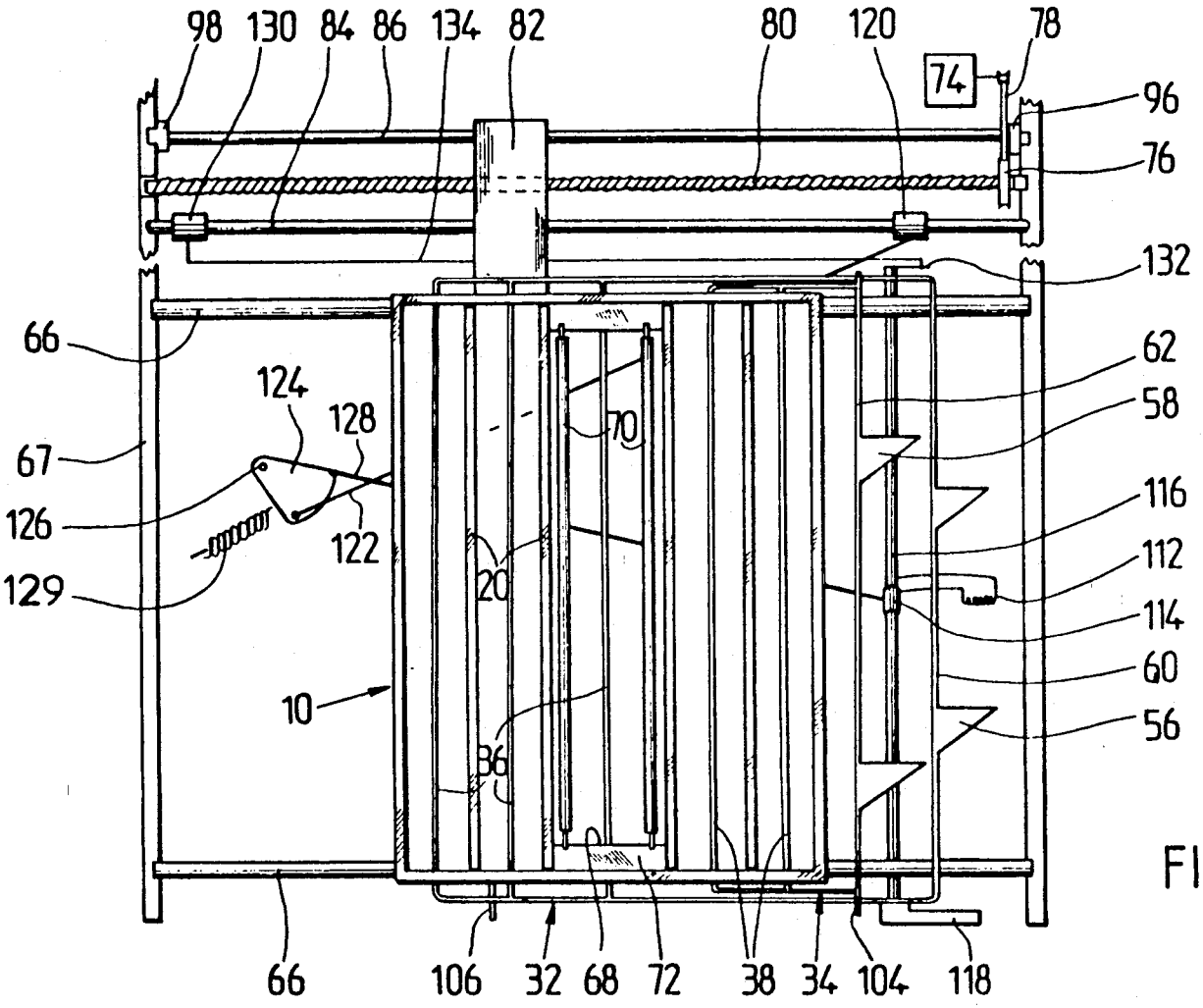
FIG. 2 is a top view of the dispenser of FIG. 1, the mobile floor being omitted for the sake of clarity of the drawing.
Figure 3:
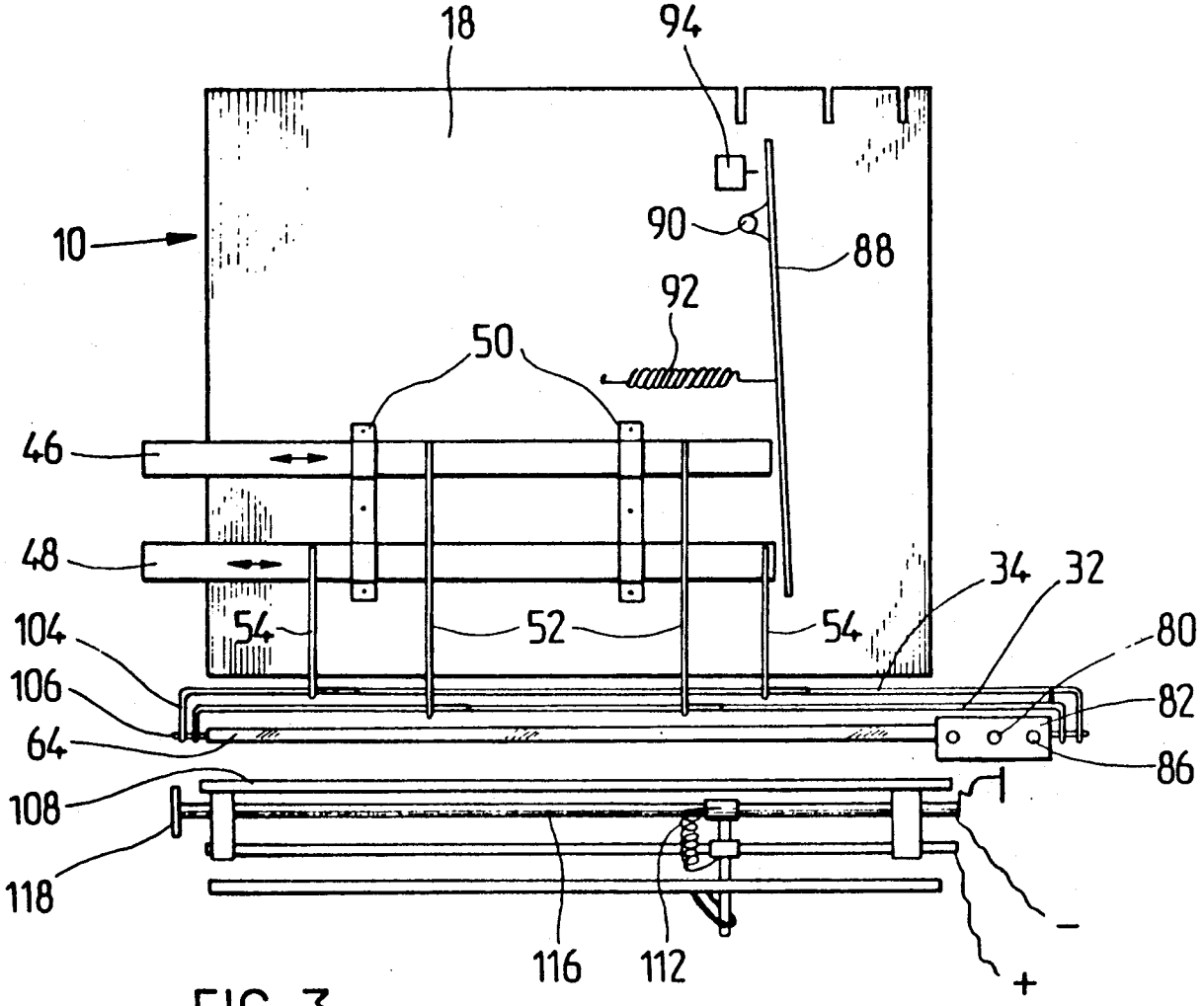
FIG. 3 is a side elevational view of the dispenser of FIG. 1.

With reference to FIGS. 1 to 3, the dispenser comprises a parallelepipedic shaped magazine 10, but which may have any other appropriate shape. The magazine comprises a front wall 12, a rear wall 14 and two side walls 16, 18 and is open at its upper and lower ends. It is divided on the inside, by vertical dividing walls 20 parallel to the side walls 16, 18, into compartments 22 (5 in the case of FIG. 1) extending over the whole height of the magazine. Each compartment receives a stack of cigarettes 24 of different brand and/or dimensions, lying in a flat position. The compartments are wider and longer than the largest and longest cigarette, so that the cigarettes which are placed therein may drop by gravity without rubbing against the walls of the compartments.

For the sake of simplicity, it has been assumed in FIG. 1 that the three compartments situated on the left contain cigarettes of the same brand and that the other two compartments contain cigarettes of another brand and are longer.

The respective lengths of the different compartments are adapted to that of the cigarettes which they receive by means of movable transverse dividing walls 26, in the form of a comb, whose slits 28 fit into notches 30 formed in the upper edges of the dividing walls 20. For the sake of clarity in FIG. 1, only a single dividing wall 26 has been shown which extends over the width of the three compartments situated on the left. Dividing wall 26 is positioned so as to push the cigarettes from the compartment against the front wall 12 of the magazine.

The cigarettes are retained in the magazine by means of retractable selection devices, of any appropriate type which, in the case of FIG. 1, are formed by two grids 32, 34 mounted under the magazine. Grid 32 associated with the first three compartments comprises three horizontal cross pieces 36 parallel to the axis of the compartments and spaced from each other by a distance equal to the distance between the axes of the compartments. Similarly, grid 34 associated with the last compartments comprises two cross pieces 38 also spaced apart by a distance equal to the distance between the axes of the compartments. Each of grids 32, 34 may be brought selectively from a first position (shown in FIGS. 1 and 2) in which its cross pieces are situated substantially in the axis of the compartments, thus retaining the cigarettes in their respective compartment, to a second position in which its cross pieces are placed under the dividing walls 20, thus allowing the cigarettes from the corresponding compartments to pass.

In the embodiment illustrated, in which the dispenser only comprises two types of cigarettes, only two grids are used. But it is evident that in the general case in which each compartment contains a different type of cigarette, a grid will be provided for each compartment. In this case, each grid will comprise only a single cross piece.

Grids 32, 34 are guided in their movement between their two above mentioned endmost positions by guides of any known type. In FIG. 1, these guides are formed by rigid rings 40 fixed to the lower edge of the front and rear walls of the magazine and through which pass the side members 42, 44 of the grids.

The grids may be moved from their blocking position to their open position by means of independent push rods 46, 48, two in number in the case illustrated, but equal in number to that of the compartments in the general case.

The push rods are formed by rods fixed horizontally, by means of fastenings 50, to the external face of the side wall 18 of the magazine. The push rods may be driven manually against the force of springs, not shown, and their movement in the direction of arrow f in FIG. 1 is transformed into a movement of the grids, into a leftward perpendicular movement of the grids by means of any appropriate transmission device.

One embodiment of such a transmission will be described by way of non limitative example. The push rods 46, 48 have vertical feelers 52, 54 whose lower ends extend downwardly as far as the level of horizontal cam elements 56, 58 fixed respectively to endmost cross pieces 60, 62 of the grids. These cam elements are formed by triangular shaped plates welded by one of their sides to the corresponding end cross piece, and one of whose sides is slanted in the driving direction of the push rods. The lower ends of feelers 52, 54 bear against the slanting sides. The result is that when a push rod is driven, the feelers which it carries, bearing against the slanting sides of the cam elements, force the corresponding grid to move leftwards in FIG. 1. The driving stroke of the push rods and the length of the slanting sides of the cam elements are calculated so that the grids move by a distance equal to half that separating two successive dividing walls 20 of the magazine.

Under the grids 32, 34 is mounted a mobile floor 64 which rests on two support rods 66 fixed to a frame 67 and on which it may move in a direction perpendicular to the longitudinal axis of the compartments. The mobile floor has advantageously a flexible structure and, for this, it is made from strip plates juxtaposed and hinged together so as to be able to bend, but the floor may of course have any appropriate flexible structure.

The mobile floor has, substantially in the middle of its length, an elongate opening or cell 68 (FIG. 2) parallel to the horizontal axis of the compartments and of a width greater than the diameter of a cigarette. Along the longitudinal sides of this opening are mounted rollers 70 which are journalled in connecting plates 72.

The mobile floor is driven over the supporting rods 66 in a direction perpendicular to the longitudinal axis of the compartments by a reversible motor 74 (FIG. 2) driven by any power source, for example by the mains power, directly or through a transformer. For this, the movement of the shaft of the motor is transmitted, for example through a belt 78 and pinion 76 transmission, to an endless threaded rod 80 journalled for rotation in frame 67. The threaded rod has a direction perpendicular to the longitudinal axis of the compartments and it is screwed through a carriage 82 which is fixed to the mobile floor 64. When the threaded rod 80 is rotated by the motor, the carriage moves in one direction or in the other, taking with it the mobile floor. In its movement, the carriage is guided by two parallel guide rods 84, 86 supported by frame 67.

The motor 74 is started up when one of the selection push rods 46, 48 is pushed in. As can be seen clearly in FIG. 3, the internal end of the push rods is in contact with a lever 88 mounted for pivoting about pin 90. When one of the push rods is pushed in, it causes the lever to pivot against the force of a spring 92, the lever 88 then actuating a contact 94 which closes the power supply circuit for motor 74.

At the ends of one of the guide rods of carriage 82, for example rod 86, are respectively fixed a reverser 96 for reversing the movement of the motor and an end of travel contact 98 for stopping the motor, which are actuated by the carriage. In an operating cycle, the carriage-mobile floor assembly travels initially upwardly, towards the right in FIGS. 1 and 2, then returns in the opposite direction.

The grids have at their ends hooked portions 102, 104 situated in the path of two fingers 106 which project from the connecting plate 72 of the mobile floor. The fingers are adapted for bringing back to its locking position the grid which was moved to its open position.

Under the mobile floor is mounted a fixed floor 108 which has, on the outward end-of-travel side of cell 68 of the mobile floor 74, a housing 110 parallel to the longitudinal axis of the compartment and adapted for receiving a cigarette 24.

This latter may be lit by a heater 112 fed by the power source and supported by a sleeve 114 mounted for sliding along a guide rod 116. When the sleeve moves along the guide rod 116, the heater moves in the axis of housing 110, thus urging the cigarette which is situated there against a closure flap 118 fixed at the front end of the guide rod 116. In the rest position, the heater 112 is at a distance from flap 118 less than the length of a cigarette.

The movement of the heater 112 is controlled by carriage 82 through a transmission of any appropriate type. In FIG. 2, this transmission comprises a sleeve 120 mounted for sliding on the guide rod 84, on the outward end-of-travel side of the carriage, a first rigid rod 122 fixed by its ends to the sleeve and to a counter motion device 124 mounted for pivoting about a vertical pin 126, and a second rigid rod 128 fixed by its ends to said countermotion device and to sleeve 114. The counter motion device is normally held by a spring 129 in a position in which sleeve 114 which supports the heater 112 is relatively close to flap 118.

The opening of flap 118 is controlled by the movement of the carriage at the moment when it approaches the end of travel contact 98. For this, the guide rod 84 has in the vicinity of said contact a sleeve 130 connected to a lever 132 fixed to one end of guide rod 116 by a traction arm 134. The guide rod 116 is mounted for pivoting about its axis, so that when sleeve 130 is pushed leftwards in FIG. 2, flap 118 is pivoted to its open position.

The operation of the dispenser will now be described: initially, the grids 32, 34 have their respective cross pieces 36, 38 opposite the lower openings of compartments 22, thus retaining the cigarettes 24 in their respective compartment, and the mobile floor 64 is positioned so that its opening 68 is under the leftmost compartment in FIGS. 1 and 2.

The user pushes in the push rod which corresponds to the brand of cigarette he has chosen, for example push rod 48. This movement causes:

lever 88 to pivot and so contact 94 to close, which causes heater 112 to light up and starts up motor 74, this latter then rotating the threaded rod 80 in a direction in which carriage 82 and the mobile floor 64 move rightwards in FIGS. 1 and 2, and selection grid 34 to move leftwards in FIGS. 1 and 2 through the feelers 54 and cam elements 58. The cross pieces 38 of grid 34 then come under the thickness of dividing walls 20, thus freeing the last two compartments.

When the opening 68 in the mobile floor arrives under the last but one compartment, a cigarette 24 falls through the opening 68 and is laid on the fixed floor 108. This cigarette is thus driven by the mobile floor rightwards in FIGS. 1 and 2, rollers 70 preventing the cigarettes remaining in compartments 22 from being jammed between the mobile floor 64 and dividing walls 20. Of course, the spacing between the fixed floor and the lower edge of the magazine must be greater than the diameter of the cigarettes.

Before arriving at the outward end of travel, carriage 82 abuts against sleeve 120 and moves it rightwards in FIGS. 1 and 2, which causes the counter motion device 124 to rotate in an anticlockwise direction, against the force of spring 129, thus exerting a pull on rod 128 and moving sleeve 114 and heater 112 in a direction away from the closure flap 118. Finger 106 of carriage 82, coming into engagement against the hooked portion 104 of grid 34, brings this latter back to its initial position where it closes off the associated compartments.

At the outward end of travel, the driven cigarette falls into the receiving housing 110 from which heater 112 has been previously withdrawn as was explained. Simultaneously, carriage 82 acts on reverser 96 which reverses the movement of motor 74, so that the threaded rod 80 rotates in the opposite direction. The carriage and the mobile floor then begin their return movement. The device may comprise an additional resistor for reducing the speed of the motor on its return path. Thus the heater 112 is held applied against the cigarette for the time required for lighting.

As soon as the carriage has moved sufficiently leftwards in FIGS. 1 and 2, with sleeve 120 released, spring 129 returns this latter as well as the counter motion device 124 to their initial position, so that sleeve 114 and heater 112 draw near to flap 118. The heater is then applied against the end of the cigarette and lights it, at the same time as it applies the cigarette against flap 118.

In its return path, cell 68 of the mobile floor 64 passes under the last two right hand compartments of FIGS. 1 and 2, but it does not collect a cigarette since grid 34 has been previously brought back into a blocking position, as explained above.

Carriage 82 then drives sleeve 130 leftwards, which causes the flap to open and so the cigarette to be expelled from housing 110 under the thrust of heater 112.

Finally, carriage 82 engages the end of travel contact 98 which stops motor 74 and switches off heater 112.

Thus, a single gesture of the user—pressing in the push rod—is sufficient to cause the dispensing and lighting cycle to take place automatically. The dispenser automatically handles a cigarette of a chosen brand, lights it and serves it to the user.

It is obvious that numerous modifications of detail may be made to the embodiment described without departing from the scope of the invention. Thus, for example, the selection grids may be replaced by rocking levers mounted for pivoting through the front face of the magazine, which is open, said rocking levers normally occupying blocking position in which they apply at least the lower cigarettes against walls 26 or 14, thus retaining them in the compartments, and an unblocked position in which they are moved away from the cigarettes, these latter then being able to fall by gravity.

Furthermore, in the rest position, the cell 68 of the mobile floor and housing 110 may be situated under the central compartment and not under the leftmost compartment in FIGS. 1 and 2. The push rods corresponding to the compartments situated on the left with respect to the central compartment may then be fixed to the side wall 16 of the magazine and those corresponding to the right hand compartments will be fixed to the side wall 80. Actuation of a left hand or right hand push rod will cause the mobile floor to move leftwards, or rightwards in FIGS. 1 and 2.

In the case where the apparatus only provides two brands of cigarettes, this description allows the embodiment of the invention to be simplified. The grids or rocking levers are no longer necessary.

Figure 4:
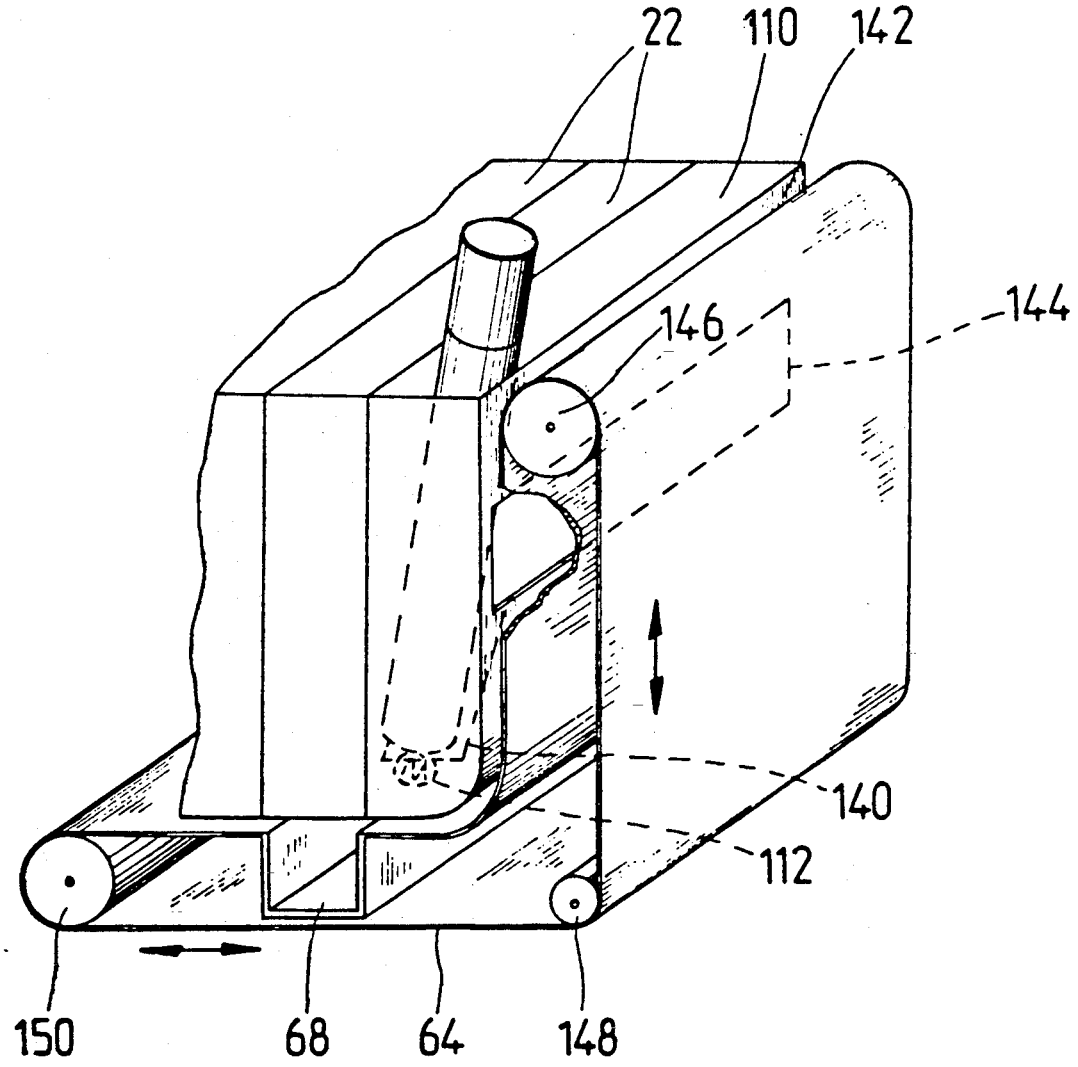
FIG. 4 is a partial perspective view of a dispenser according to a second embodiment in which the lighted cigarettes are presented at the top of the magazine.

FIG. 4 shows a variant, of the dispenser in which the lighted cigarette is presented through the top of the magazine. For the description of this Figure, numerical references will be used identical to those of similar elements in FIGS. 1 to 3.

The receiving housing 110 is here formed by a compartment similar to compartments 22 and situated at one end of the magazine, for example at the right hand side in FIG. 4. In the bottom of the housing is mounted an inclined ramp 140, at the lower end of which is disposed the lighting heater 112. This ramp or at least a part of it may pivot upwardly about a longitudinal axis passing through its lower end.

The mobile floor is formed by an endless L shaped belt 64 whose horizontal part passes under magazine 10 and whose vertical part rises along the external wall 142 of housing 11. In the vicinity of its top, said wall 142 has a horizontal aperture 144 of dimensions greater than those of a cigarette. The belt has a recess 68 for receiving a cigarette from the selected compartment 22. The belt passes around rollers 146, 148, 150 one of which is driven.

When cell 68 arrives at the level of aperture 144, the cigarette which it contains falls through said aperture into housing 110 and comes to rest on plate 140, with its end to be lit in contact with heater 112. After the time required for lighting has elapsed, plate 140 pivots upwardly thus presenting the cigarette at the top of the magazine.

Generally, the l-shaped belt 64 and pivot plate 140 of FIG. 4 may be incorporated into the dispenser shown in FIG. 1 by, first, adding the compartment 110 shown in FIG. 4 to the right of push rods 46 and 48 and the associated mechanisms 52, 54, 56 and 58 that are shown in FIG. 1, and second, then substituting l-shaped belt 64 of FIG. 4 for the mobile floor 64 of FIG. 1. Rollers 148 and 150 of FIG. 4 may be connected to frame 67 of FIG. 1 in any suitable way, and reversable motor 74 may be drivingly connected to any one of the rollers 146, 148 or 150 to move belt 64 and recess 68 selectively to the left and to the right. There need be no change in the way push rods 46 and 48 are used to operate grids 32 and 34, or in the way these push rods actuate motor 74 via contact 94, and suitably located contacts may be used to reverse motor 74 and movement of belt 64 as desired. Also, pivot plate 140 of FIG. 4 may be pivoted in any suitable way.

What is claimed is:

1. A cigarette dispensing apparatus, comprising:

support means;

a magazine supported by said support means and having an open base, an interior, and a plurality of interior walls separating said interior into a plurality of fixed compartments defining parallel longitudinal axes, each of said compartments being adapted to receive a vertically extending stack of cigarettes longitudinally extending parallel to the axis of the compartment;

selection means including, for each of the compartments, a selection device supported by the support means for movement between a normal, closed position, wherein the selection device blocks the cigarettes in the compartment from dropping through the base of the magazine, and an open position, wherein the selection device allows cigarettes in the compartment to pass through the base of the magazine;

a mobile floor supported by the support means for lateral movement across the bottom of the magazine in outward and return directions, including a cell extending parallel to the axes of the compartments for receiving one cigarette at a time;

a reversible motor connected to the mobile floor to move said floor in the outward and return directions;

a fixed housing supported by said support means to receive a cigarette carried to the fixed housing by the cell of the mobile floor, and including a first end forming an opening to discharge a cigarette from said fixed housing;

selection actuation means connected to the selection devices to move the selection devices between the closed and opened positions, and to actuate the motor to move the mobile floor in the outward direction to move the cell of the mobile floor across the bottom of the magazine to receive a selected cigarette from one of the compartments and to carry said selected cigarette to the fixed housing;

a flap supported for movement between a closed position, wherein the flap closes the first end of the fixed housing, and an open position, wherein the first end of the housing is open to discharge a cigarette therethrough;

a guide rod supported adjacent and extending along the fixed housing;

a guide sleeve slidably mounted on the guide rod;

lighting means fixed to said sleeve and extending into the housing to light a cigarette therein;

first control means actuated when the mobile floor moves in the outward direction, to move the lighting means away from the flap for a period of time to provide a space in said housing to receive a cigarette;

spring means connected to said guide sleeve to urge the lighting means against a cigarette in the housing after said period of time, to light the cigarette in the housing and to urge the cigarette out from the housing through the first end thereof; and second control means actuated when the mobile floor moves in the return direction, to move the flap to the open position thereof to eject a lighted cigarette from the housing under the urging of the spring means.

2. A cigarette dispensing apparatus according to claim 1, wherein:

the selection devices comprise a plurality of grids extending below the magazine and above the mobile floor, each grid including at least a first cross piece longitudinally extending parallel to the axes of the compartments; and each of the grids is movable between a closed position, wherein each cross piece of the grid is aligned with and extends directly below a respective one of the compartments, and an open position, wherein each cross piece of the grid is aligned with and extends directly below one of the walls of the magazine.

3. A cigarette dispensing apparatus according to claim 2, wherein:

the selection means further includes a plurality of movable push rods, each push rod being connected to a respective one of the grids to move said one grid between the open and closed positions thereof;

the lighting means includes a heater; and movement of the push rods also actuates the motor and the heater.

4. A cigarette dispensing apparatus according to claim 3, wherein:

the magazine includes a lateral face;

the grids are supported for horizontal sliding movement;

the push rods are mounted on the lateral face of the magazine and are supported for sliding movement in a first direction parallel to the axes of the compartments; and the dispensing apparatus further comprises first transmission means connecting the push rods to the grids, and transforming movement of the push rods in said first direction into horizontal movement of the grids.

5. A cigarette dispensing apparatus according to claim 4, wherein:

the first transmission means includes i) a plurality of cams, at least one cam being connected to each grid, and a plurality of feelers, at least one feeler being connected to and extending vertically downward from each push rod to engage one of the cams;

the fixed compartments have uniform widths;

when the push rods are moved in said first direction, the feelers engage the cams and force the grids backwards a distance equal to half of said uniform width.

6. A cigarette dispensing apparatus according to any one of claims 2-5, wherein the mobile floor includes an engagement member for moving at least one of the grids from the open position thereof to the closed position of the grid during movement of the mobile floor in the return direction.

7. A cigarette dispensing apparatus according to any one of claims 1-5, wherein:

each compartment has a normal length;

at least one of the interior walls includes an upper edge having at least one notch; and the apparatus further includes a transverse dividing wall held in said notch and extending into one of the compartments to adapt said one compartment to hold cigarettes having a length less than said normal length.

8. A cigarette dispensing apparatus according to claim 1, wherein the selection devices include a plurality of rocking levers, each of the rocking levers being supported for pivotal movement between a first, normal position wherein the rocking lever extends into a respective one of the compartments and bears against cigarettes in said one compartment to hold the cigarettes therein against a back wall of the magazine, and a second position, wherein the rocking lever is spaced from the cigarettes in said one compartment to allow the cigarettes therein to drop from said one compartment.

9. A cigarette dispensing apparatus according to claim 1, for use with cigarettes having a maximum width less than a given width, and wherein:

the cell is formed by a longitudinally extending opening in said mobile floor, said opening having a width greater than said given width;

the mobile floor further includes a pair of longitudinal rollers extending along longitudinal edges of said cell; and the apparatus further comprises a fixed floor supported by the support means below the cell of the mobile floor, to support cigarettes held in said cell.

10. A cigarette dispensing apparatus according to any one of claims 1-5 wherein:

the motor includes a rotatable motor shaft, actuation of the motor causing the motor shaft to rotate; and the apparatus further includes a second transmission means to transform motion of the motor shaft into rectilinear motion of the mobile floor, the second transmission means comprising i) a threaded rod rotatably supported by the support means and extending perpendicularly to the axes of the compartments, ii) a carriage fixed to the mobile floor for movement therewith and threaded onto the threaded rod for movement therealong, and iii) means connecting the motor shaft to the threaded rod to rotate the threaded rod and move the carriage therealong.

11. A cigarette dispensing apparatus according to claim 10, wherein:

the second transmission means further includes a pair of carriage guide rods supported by the support means and extending parallel to said threaded rod; and the carriage is slidably mounted on said carriage guide rods, and said carriage guide rods guide movement of the carriage along said threaded rod.

12. A cigarette dispensing apparatus according to claim 11, wherein:

the carriage moves to one side as the mobile floor moves in the outward direction;

the first control means includes i) a control sleeve slidably mounted on one of the carriage guide rods, on said one side of the carriage, ii) a counter motion device mounted on the support means for pivotal movement about a vertical axis, iii) a first rigid rod having one end connected to the control sleeve and another end connected to the counter motion device, and iv) a second rigid rod having one end connected to the counter motion device and another end connected to the guide sleeve; and the spring means is connected to the counter motion device and normally holds the counter motion device in a position wherein the counter motion device holds the lighting means relatively close to the flap.

13. A cigarette dispensing apparatus according to claim 11, wherein:

the carriage moves to one side as the mobile floor moves in the return direction;

the second control means includes i) a control sleeve slidably mounted on one of the carriage guide rods, on said one side of the carriage, ii) a rigid rod supported for pivotal movement about a rod axis, and having one end connected to the flap, iii) a lever connected to the rigid rod for pivotal movement therewith, iv) a rigid arm having one end connected to the control sleeve for movement therewith, and having another end connected to the lever to pivot the lever and the rod, wherein sliding movement of the control sleeve along said one of the carriage guide rods pivots the lever and the rigid rod about said rod axis, and moves the flap between the open and close positions thereof.

14. A cigarette dispensing apparatus according to claim 11, wherein:

the carriage slides along the carriage guide rods between outward end and return end positions;

the carriage moves to said outward end position when the mobile floor moves in the outward direction, and the carriage moves to said return end positions when the mobile floor moves in the inward direction; and the apparatus further comprises i) a reverser mounted on one of the carriage guide rods at the outward end position of the carriage to engage the carriage and reverse the direction of the motor, to thereby reverse the direction of movement of the carriage and the mobile floor, when the carriage reaches said outward end position, and ii) a stop switch mounted on one of the carriage guide rods at the return end position of the carriage to engage the carriage and stop the motor, to thereby stop movement of the carriage and the mobile floor, when the carriage reaches said return end position.

15. The cigarette dispensing device as claimed in any one claims 1-5, further comprising timing means for holding said heater applied against the cigarette for the time required for lighting it, said timing means being formed by a resistor to reduce the speed of the motor.

16. The cigarette dispensing apparatus as claimed in claim 1, wherein said cell and said housing are placed in the middle of the magazine.

17. The cigarette dispensing machine as claimed in claim 1, wherein said housing is situated in a housing compartment identical to one of said fixed wall compartments and situated at one of the ends of the magazine, the bottom of said housing compartment being formed by an inclined pivoting plate, at the base of which said heater is mounted, the external side wall of said housing compartment having at its upper part a horizontal aperture of dimensions greater than those of the cigarette and wherein said mobile floor is formed by a generally L shaped endless belt whose upper horizontal side passes under the magazine and comprises a cell with flat bottom and vertical sidewalls and whose vertical side passes in front of said aperture, so that when said cell passes in front of the aperture the cigarette falls therethrough on to the plate which moves it from the inclined position to a substantially vertical position.

* * * * *

UNITED STATES PATENT AND TRADEMARK OFFICE

CERTIFICATE OF CORRECTION

PATENT NO. : 5,113,879

DATED : May 19, 1992

INVENTOR(S) : Alain Alleon

It is certified that error appears in the above-identified patent and that said Letters Patent is hereby corrected as shown below:

ON THE TITLE PAGE:

In the Abstract, line 4: "such" should read as --each--

In the Abstract, lines 10-11: "the lighting" should read as --the a lighting--

Signed and Sealed this

Thirty-first Day of August, 1993

Bruce Lehman

*Attest:*

BRUCE LEHMAN

*Attesting Officer*

*Commissioner of Patents and Trademarks*